United States Patent [19]

Leek

[11] 4,132,458

[45] Jan. 2, 1979

[54] ROTATING CHAMBER FOR FOOD FREEZER

[76] Inventor: James A. Leek, R. 12 Box 317, West Terre Haute, Ind. 47885

[21] Appl. No.: 835,516

[22] Filed: Sep. 22, 1977

[51] Int. Cl.[2] ..... A47F 3/04; F25D 25/00

[52] U.S. Cl. ..... 312/305; 62/381; 165/76; 165/80; 165/90

[58] Field of Search ..... 312/11, 125, 197, 305, 312/266, 97.1; 62/381, 346; 165/89, 90, 91, 76, 80

[56] References Cited

U.S. PATENT DOCUMENTS

| | | | |
|---|---|---|---|
| 1,560,967 | 11/1925 | Bowlus | 62/381 |
| 2,380,005 | 7/1945 | Wilson | 312/305 |
| 2,441,376 | 5/1948 | Stiening | 312/305 |
| 2,693,989 | 11/1954 | Santana et al. | 312/305 |
| 3,797,272 | 3/1974 | Huey | 62/381 |

*Primary Examiner*—Mervin Stein
*Assistant Examiner*—Alex Grosz
*Attorney, Agent, or Firm*—Woodard, Weikart, Emhardt & Naughton

[57] ABSTRACT

Disclosed is an assembly which can be inserted into an existing food freezer or which can be built into the freezer. It includes upper and lower supporting jackets which enclose a cylindrical stainless steel basket journalled to rotate on a horizontal axis. Spaced curved walls within the cylindrical basket divide its interior into a plurality of curved, cylindrical segment-shaped chambers. Each chamber has an individual lid or closure and the basket may be rotated to place the selected chamber uppermost and its interior accessible. The curved sidewalls of the chambers permit the closures to be lowered into and fastened within the chambers to prevent articles in a partially filled chamber from tumbling as the basket is rotated.

2 Claims, 6 Drawing Figures

ROTATING CHAMBER FOR FOOD FREEZER

BACKGROUND OF THE INVENTION

In domestic food freezers, particularly chest-type freezers, a persistent problem has been the difficulty in locating a specific package of frozen food (a particular cut or variety of wrapped meat, for example) in a full or semifull freezer. If the desired package is deep within the freezer, overlying packages must be removed by hand, a distinctly uncomfortable exercise, until the desired article is accessible. Cooling loss, and hence energy loss, is inherent in this method of retrieving particular articles from the freezer since the freezer closure must be kept open during the hand sorting of the articles.

Prior art attempts at solution to this problem have included use of circular racks rotatable upon a vertical axis, in lazy-susan fashion, within a refrigerator (U.S. Pat. No. 2,680,668). A cylindrical basket, divided into cylindrical segments, rotated on a horizontal axis has been used in wine cooling (U.S. Pat. No. 2,447,602), however, in thses prior art structures, no provision is made for arresting the tumbling of articles in a partially full segment or chamber as horizontal axis rotation proceeds.

The present invention utilizes a horizontal, cylindrical basket, divided by curving walls into segmental chambers, and utilizes hinged closures for each chamber. The curved configuration of the chamber sidewalls permits the closures to swing inwardly and be fastened in their chambers to thus hold articles from tumbling within a partially filled chamber during rotation of the basket. The assembly of the present invention may be inserted into an existing freezer or can be incorporated into a freezer designed specifically to receive the assembly.

DESCRIPTION OF THE PREFERRED EMBODIMENTS

Figure 1:
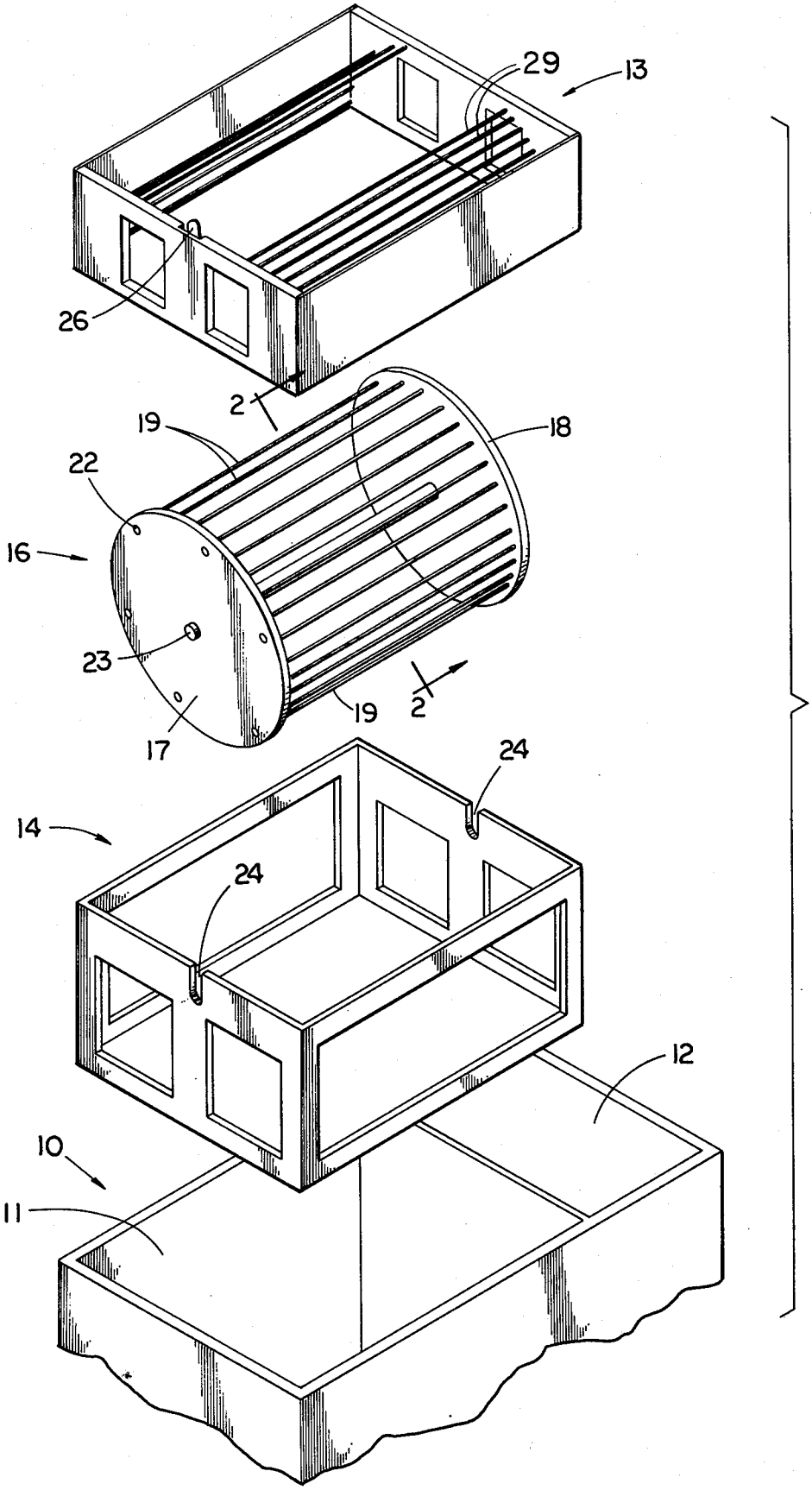
FIG. 1 is an exploded, perspective view of the apparatus of the present invention.

Referring initially to FIG. 1, there is shown schematically at 10 a conventional chest-type food freezer (the lid having been omitted for clarity) having a rectangular food storage compartment 11 and a fast-freeze compartment 12.

The apparatus of the present invention comprises an upper mounting jacket 13, a lower mounting jacket 14 and a cylindrical housing or drum 16. The jackets 13 and 14 are rectangular in configuration, have cut-out end portions, and are sized to fit within the food storage compartment 11. The housing 16 fits within the mounting jackets and is formed by circular end plates 17 and 18 between which extend stainless steel rods 19.

Figure 2:
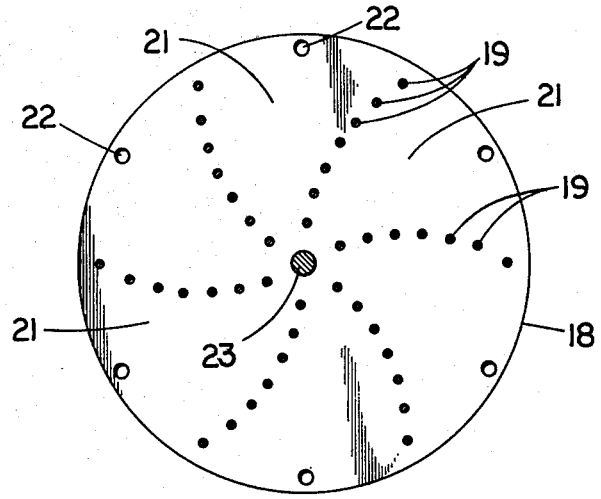
FIG. 2 is a side sectional view of the cylindrical housing or drum component taken generally along the line 2—2 of FIG. 1.
Figure 5:
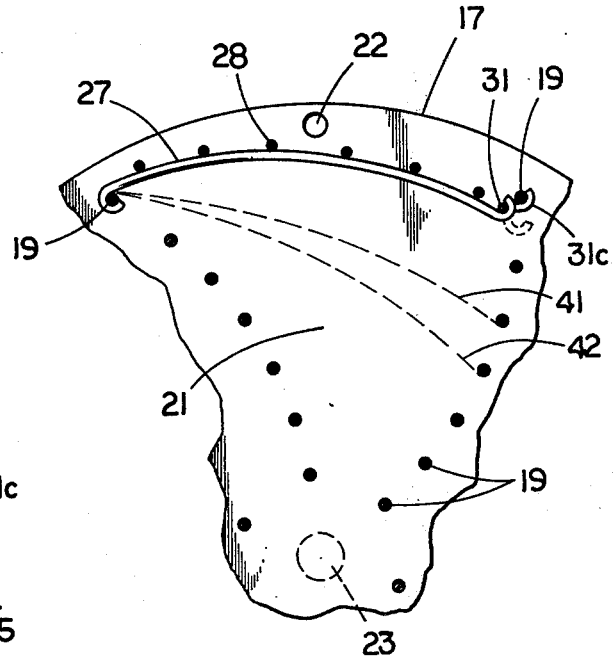
FIG. 5 is an enlarged, fragmentary, sectional view taken generally along the line 5—5 of FIG. 4.

As will be evident from FIGS. 2 and 5, the rods 19 are parallel and are grouped so as to divide the cylindrical housing into a plurality of chambers 21 (FIG. 2) of generally cylindrical segmental configuration. The lines of intersection of the groups of rods 19 with the end plates 17 and 18 are uniformly curved for a purpose which will be explained subsequently with reference to FIGS. 4 and 5. While circular end plates 17 and 18 are shown as solid discs, it will be understood that areas between the groupings of rods 19 (defining the ends of chambers 21) might be provided with cut-out areas closed by mesh screening to facilitate air circulation through the cylindrical housing.

Each of the end plates 17 and 18 is provided with a series of apertures 22 adjacent its periphery, each aperture being generally centered over one of the segmental chambers 21. The cylindrical housing 16 is adapted to turn on a horizontal axis and to accomplish this, each of the end plates has a stub shaft 23 extending outwardly from its surface. The shafts 23 are journalled in cut-out bearing areas 24 (FIG. 1) in the opposite ends of the lower supporting jacket 14, the shafts being locked in the bearing areas by the overlying upper support jacket 13.

Figure 3:
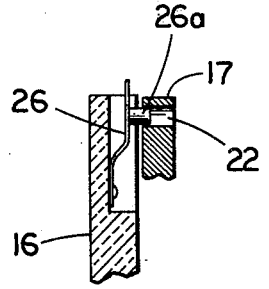
FIG. 3 is an enlarged, fragmentary, sectional view of the latching mechanism for the drum.

On the inner surface of one end of the support jacket 13 there is mounted an upwardly extending resilient blade 26, the upper, free end of the blade being visible in FIG. 1 and shown in detail in FIG. 3. Intermediate its ends the blade carries a pin **26*a* which fits within the registering one of the apertures 22, latching the cylindrical housing against rotation. The blade is inset in the jacket 16 so that the pin may be removed from aperture 22 by finger pressing the free end of the blade leftwardly, as viewed in FIG. 3, thereby releasing the housing 16** for incremental rotation.

Each of the segmental chambers is closed by a lid or closure hinged to the cylindrical housing. As may best be seen in FIG. 4, each closure is formed of longitudinal wires or rods 27 and spaced transverse wires 28. One end, **27*a*, of each of the wires 27 is looped loosely around the upper wire 19 of the group forming the left side, as viewed in FIG. 4, of the indicated segmental chamber 21. This forms a hinge for the closure. The other ends 27*b* of the wires 27 are looped around a transverse wire 31 which is provided with an offset portion 31*a* intermediate its ends. A torsion spring 32 is anchored at one end to the wire 31, encircles a portion of the wire, and is anchored at its other end on the adjacent wire 27. The torsional force exerted by spring 32 urges the offset portion 31*a* downwardly, as viewed in FIG. 4, against the underlying transverse member 28**.

The ends of the wire 31 are bent forwardly, at **31*b*, and upwardly, as indicated at 31*c*, adjacent the uppermost member 19 of the group forming the right side (as viewed in FIGS. 4 and 5) of the indicated segmental chamber 21**.

Figure 4:
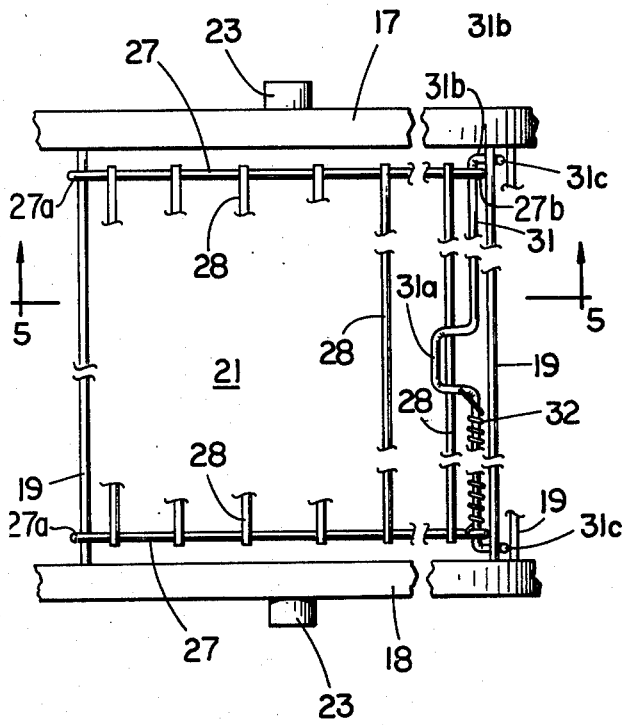
FIG. 4 is a fragmentary, top plan view of a portion of the drum component showing one of the segmental chambers and its closure.

As will be evident from FIGS. 4 and 5, the chamber 21 may be opened, at its top, by lifting the offset portion **31*a* against the bias of spring 32. This rotates wire 31 to lower its portion 31*c* to its broken line position of FIG. 5 so that the closure may clear the adjacent wire 19 and swing upwardly about the hinge formed at its opposite end. With the offset portion 31*a* in raised position, the closure may be lowered into the chamber 21 and locked on the appropriate wire 19, alternate, lowered positions of the closure being indicated by broken lines 41 and 42** in FIG. 5. It will be noted that in these lowered positions of the closure, it may be made to rest against the articles in a partially filled segmental chamber. Fastening the closure in the selected one of these inward positions holds the freezer contents against tumbling in the chambers as the cylindrical housing is rotated about its horizontal axis.

The ability of the chamber closures to swing inwardly to selected, inward positions results from the curved arrangement of the groups of transverse wires 19 making up the sidewalls of the segmental chambers 21. The wires 19, in each group, present a curved contour which corresponds generally to the arc through which the free ends of wires 27 pass as the closure is pivoted at the wire ends 27*a* about appropriate uppermost wire 19 to move the closure through positions 41 and 42 of FIG. 5. The closure can thus be lowered into chamber 21 as required, a closure motion not possible if the groups of wires 19 extended in radial, rectilinear contour. This curved contour of the chamber walls is thus an important feature of the present invention. The upper support jacket 13 (FIG. 1) may, if desired, be provided with members 29 which extend parallel to the cylindrical housing 16 just above the curved surface of the housing. These provide additional shelf or bin space for articles which are not placed in the housing 16.

In operation, articles in the segmental chambers 21 may be individually removed by releasing the catch 26 and rotating cylinder 16 until the selected chamber is uppermost. The closure for this chamber may then be loosened, by manipulation of the element 31*a* on the closure, and the closure pivoted upwardly to give access to the chamber. After removal of the desired articles, the closure may be moved downwardly until it engages the uppermost of the articles remaining in the chamber and refastened. The cylinder 16 may then be rotated to advance a further selected one of the chambers 21 into uppermost, accessible position if further withdrawal of articles from the housing 16 is to occur.

Figure 6:
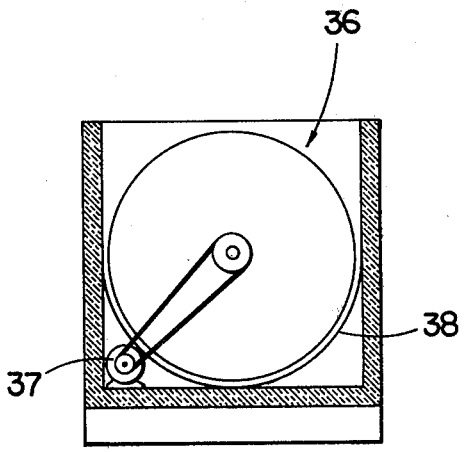
FIG. 6 is a schematic, side sectional view of a modified form of the apparatus of the present invention.

FIG. 6 schematically shown the apparatus in place in a freezer designed particularly to accommodate it. Here the cylindrical housing 36 may be journalled in the freezer sidewalls and a motor drive 37 may be provided for the housing.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An assembly for a food storage freezer comprising a cylindrical housing and mounting means permitting rotation of the housing on a central horizontal axis within said freezer, said housing having circular end plates between which extend spaced parallel members arranged to divide the cylindrical housing into a plurality of chambers of generally cylindrical segmental configuration, and closures for the open tops of each of said segmental chambers, each of said closures being hinged along one of its side margins to said housing and curved to conform to the peripheral curvature of said circular housing end plates, whereby rotation of the housing sequentially presents said chambers for access to their contents, said means for mounting said cylindrical housing including a lower mounting jacket and an upper mounting jacket both of rectangular configuration and sized to fit within the food storage compartment of a freezer in stacked relation, said cylindrical housing being disposed within said stacked mounting jackets and journalled for rotation adjacent the upper margin of the opposite ends of said lower mounting jacket, said upper mounting jacket having members extending parallel to said cylindrical housing above the curved upper surface of the housing to provide a stationary storage area for articles not placed in said housing.

2. An assembly for a food storage freezer as claimed in claim 1 in which manually operable cooperating latching elements are provided on said upper mounting jacket and on said cylindrical housing for holding a selected one of said plurality of chambers in said housing in uppermost position.

* * * * *